US008322784B2

(12) United States Patent
Ayre et al.

(10) Patent No.: US 8,322,784 B2
(45) Date of Patent: Dec. 4, 2012

(54) COLLAPSIBLE CHAIR

(76) Inventors: William Henry Ayre, Seattle, WA (US); Timothy J. C. O'Shea, Seattle, WA (US)

( * ) Notice: Subject to any disclaimer, the term of this patent is extended or adjusted under 35 U.S.C. 154(b) by 182 days.

(21) Appl. No.: 12/837,130

(22) Filed: Jul. 15, 2010

(65) Prior Publication Data

US 2011/0169305 A1 Jul. 14, 2011

Related U.S. Application Data

(60) Provisional application No. 61/271,194, filed on Jul. 17, 2009.

(51) Int. Cl.
*A47C 4/28* (2006.01)

(52) U.S. Cl. ..... 297/45; 297/31

(58) Field of Classification Search ..... 297/16.2, 297/42, 44, 45, 31
See application file for complete search history.

(56) References Cited

U.S. PATENT DOCUMENTS

| | | | | | |
|---|---|---|---|---|---|
| 2,354,949 | A | * | 8/1944 | Ducavich | 297/45 |
| 3,228,724 | A | | 1/1966 | Resar | |
| 4,273,350 | A | * | 6/1981 | Williams | 280/250.1 |
| 4,359,244 | A | | 11/1982 | Koehm | |
| 4,697,823 | A | * | 10/1987 | Kassai | 280/644 |
| 4,863,181 | A | * | 9/1989 | Howle | 280/250.1 |
| 4,889,383 | A | | 12/1989 | Jones | |
| 4,890,882 | A | | 1/1990 | Harrington | |
| 5,244,250 | A | | 9/1993 | Nordmeyer | |
| 5,415,455 | A | | 5/1995 | Geldbaugh | |
| 5,519,782 | A | | 5/1996 | Shinohara et al. | |
| 5,562,330 | A | * | 10/1996 | Jane Cabagnero | 297/42 |
| 5,609,279 | A | | 3/1997 | O'Shea | |
| 5,626,271 | A | | 5/1997 | Messey et al. | |
| 5,915,782 | A | | 6/1999 | Geldbaugh | |
| D421,191 | S | * | 2/2000 | Rand | D6/368 |
| 6,364,409 | B1 | | 4/2002 | Saul et al. | |
| 6,406,091 | B1 | | 6/2002 | Saul et al. | |

* cited by examiner

*Primary Examiner* — Peter R. Brown
(74) *Attorney, Agent, or Firm* — Lowe Graham Jones PLLC

(57) ABSTRACT

A collapsible chair constructed of tubing and fabric that is for use at the beach, camping or outdoors where portability is important to the user. The chair included folding support members that allow the chair to fold up into a small package.

5 Claims, 4 Drawing Sheets

COLLAPSIBLE CHAIR

PRIORITY CLAIM

This invention claims the benefit of U.S. Provisional Application Ser. No. 61/271,194 to inventors William H. Ayre and Timothy J. C. O'Shea, filed Jul. 17, 2009, the contents of which are hereby incorporated by reference.

BACKGROUND OF THE INVENTION

Lounge chairs have been in widespread use for many years. Such prior art type lounge chairs come in a variety of shapes and sizes. Some of these lounge chairs may be provided with cushions while other less costly lounge chairs are not.

It is also well known to carry lounge chairs to sit in while at the beach. These lounge chairs are normally made with an aluminum frame and plastic fabric to reduce the weight.

However, many of the existing designs are cumbersome, expensive and don't fold up into small enough of a package.

SUMMARY OF THE INVENTION

The present invention provides a collapsible chair constructed of tubing and fabric that is for use at the beach, camping or outdoors where portability is important to the user. The chair is easy to set-up and put-away and can be stored in a sac when not in use.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
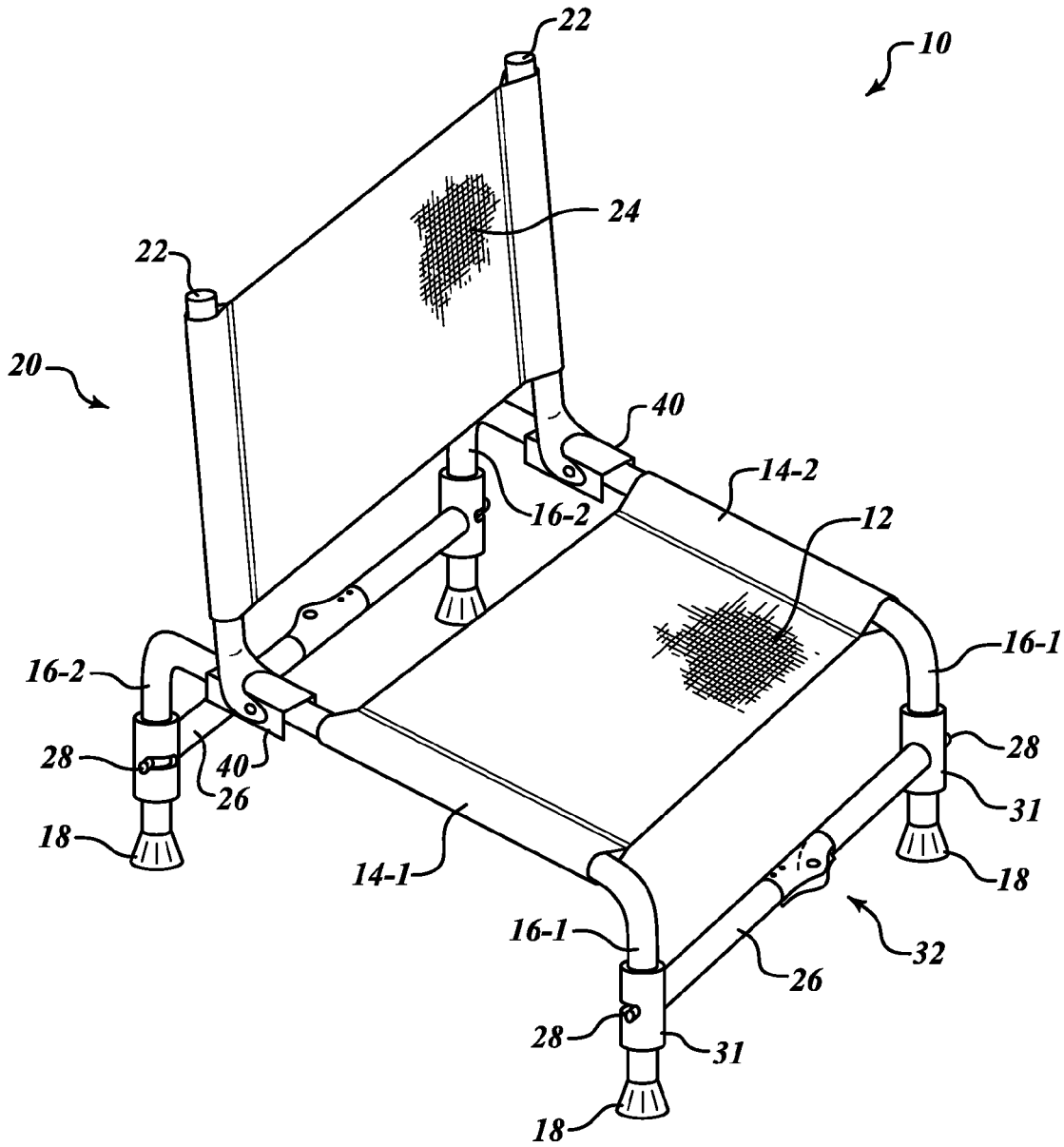
FIG. 1 is a perspective view of a preferred embodiment of the collapsible chair.

FIG. 1 shows an embodiment of a collapsible chair 10 in the operational and open position. Seat fabric 12 is tensioned taught between two main side seat tubes 14-1, 14-2 which are U-shaped having vertical ends forming legs 16-1, 16-2. The legs 16-1, 16-2 are terminated at feet 18 to spread the load and limit slippage on hard surfaces. A seat back 20 includes two tubes 22 that pivot at their lower ends on the main side tubes 14-1, 14-2 and that have seat back fabric 24 stretched between them.

Front and rear folding braces 26 press outward between the front legs 16-1 and between the rear legs 16-2 and tension the seat fabric 12. These folding braces 26 pivot at their outer ends around the legs 16-1, 16-2. In the embodiment shown these folding brace pivot points are formed of vertical tubing or sleeve 31 slightly larger than the leg tubing. A plastic bushing (not shown) may be provided between the legs 16-1, 16-2 and the sleeves 31 to reduce friction. The vertical tubing sleeves 31 transmit forces to the main seat tubes 14-1, 14-2 to maintain position of the seat tubes 14-1, 14-2. The braces 26 are also constrained in rotation motion around the legs 16-1, 16-2 by limit and retaining pins 28 fixedly attached to the legs 16-1, 16-2. The limit and retaining pins 28 move in the slots 30 in the sleeves 31, seen in FIG. 3C. The arrangement of the limit pins 28 in the slots 30 resist racking of the chair in the open position, helping maintain a rectangular relationship between the braces 26 and main side tubes 14-1, 14-2. In the closed position this arrangement of the limit pins 28 in the slots 30 assist in maintaining the general alignment of the folded chair tubes, FIG. 2B. In addition pins 28 retain the braces 26 in a fixed vertical position on the legs 16-1, 16-2. It is to be appreciated that the pivot ends of folding braces 26 (the sleeves 31) may be formed by other readily available means of producing hinges to those skilled in the art.

The braces 26 may be alternately constructed such that the brace vertical tubing sleeves extend downward from the legs to form feet (not shown) that extend toward central pivots 32. The vertical tubing sleeves 31 are shown surrounding the leg tubes in FIGS. 1, 2A, 2B, and 3C. However, the brace sleeves may be located inside the leg tubes without departing from the scope of the invention. Also alternately the limit pins 28 and slots 30 may be reversed from those described above with slots 30 in the legs and the limit pins 28 fixedly attached to the brace vertical tubing sleeves. In addition the legs may be terminated in side runners, rather than feet. Such side runners (not shown) may connect the left (front and rear) legs 16-1, 16-2 to each other and the right (front and rear) legs 16-1, 16-2 to each other, and the side runners would substantially parallel the main seat tubes 14-1, 14-2.

Figure 2A:
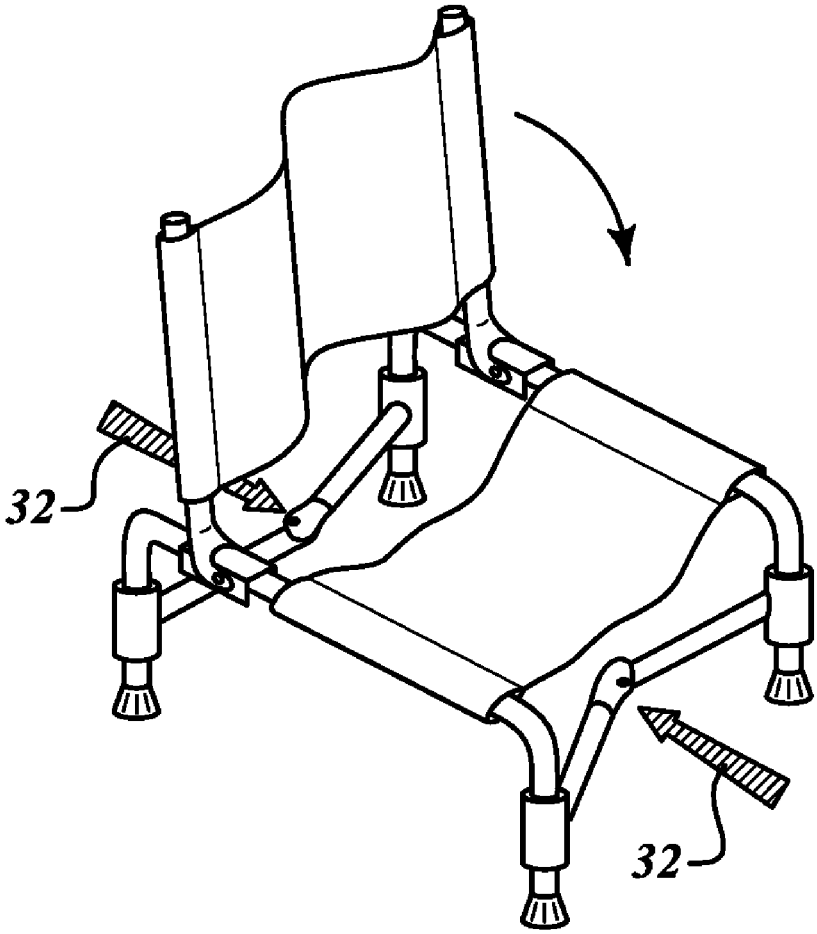
FIG. 2A is a perspective view of the embodiment of FIG. 1 at a first folding position.
Figure 2B:
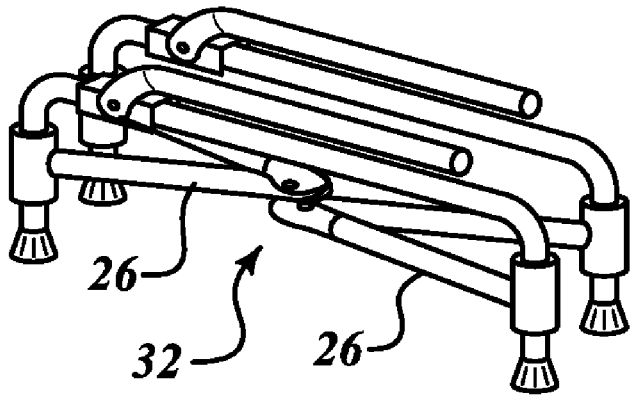
FIG. 2B is a view of the collapsed frame of the chair of FIG. 1.
Figure 3A:
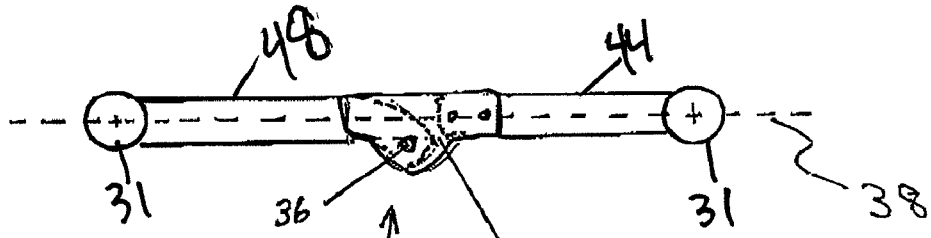
FIG. 3A is a top view of an embodiment of a folding brace in the open condition.
Figure 3B:
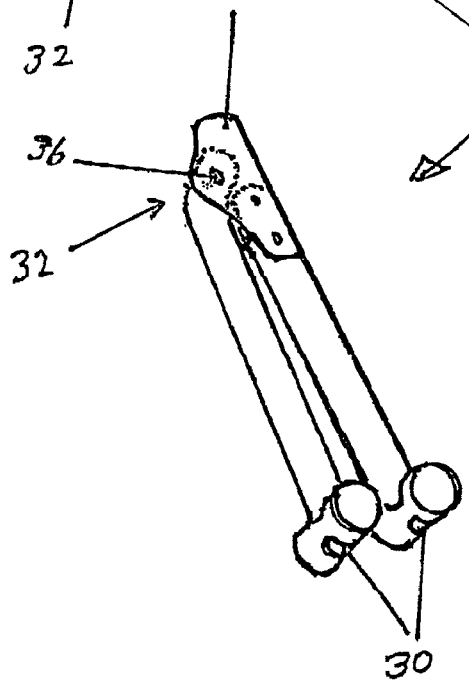
FIG. 3B is a perspective view of the folding brace of FIG. 3A in the folded position.
Figure 3C:
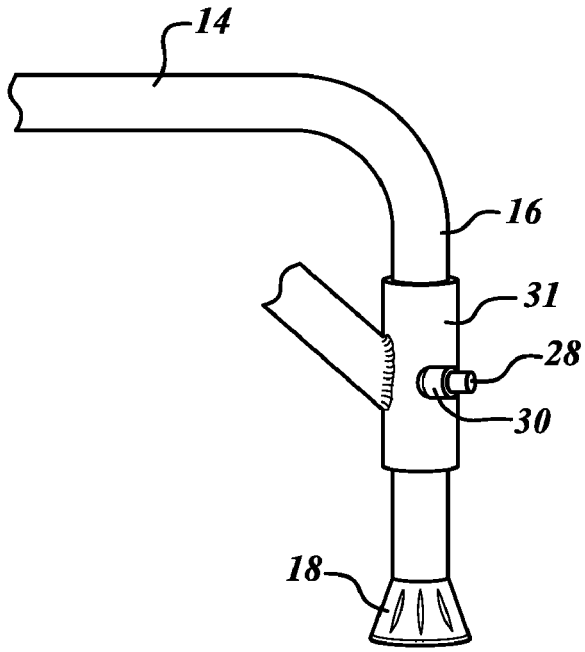
FIG. 3C is a side view of a leg with a retained brace end pivot and limit pin.

As seen in FIG. 3A each folding brace 26 has a first tube 48 and second tube 44 with the central pivot 32 connecting them near center. The central pivot 32 includes a guide plate 34 fixedly attached to the second tube 44. A pivot pin 36 attaches through a hole or inline holes in the guide plate 34 to the first tube 48. The first tube 48 is bent slightly such that in the open position the two tubes 44, 48 are substantially in line. The pivot pin 36 is off the center line of the two tubes 44, 48. When the folding braces 26 are in the open position the central pivot 32 is in an over center position such that the central pivot point has passed the central in-line point, depicted by dotted line 38 in FIG. 3A. In this position the central pivot 32 tends to stay open due to the tension of the seat fabric 12 and any additional forces placed upon the seat fabric 12. Release of the central pivot 32 requires a force to push it inward past center to fold the chair indicated by arrows in FIG. 2A showing the start of folding. The center pivots 32 are also designed such that the left and right brace tubes 44, 48 are substantially parallel and side by side when the chair is folded, FIGS. 2B and 3B. FIG. 2B shows the frame of an embodiment of the inventive folding chair in the folded condition. The front and rear folding braces 26 are positioned such that in this folded position one central pivot 32 is higher than the other such that they do not interfere with each other when in the folded position.

Alternate central pivots having over center latching or other latching may be produced within the scope of the invention, such as incorporating a spring pin in the pivoting tube of the folding brace (not shown). In the open configuration the spring pin would secure central pivot 32 in the open position by extending into a hole in the pivot guide plate 34 thereby fixing the folding brace 26 in the open configuration. Further construction of the folding braces may be of other structure than tubing without departing from the scope of the invention.

The seat back 20 described above further arises off reinforced seat back pivots 40 on the main side seat tubes with rectangular tubing reinforcement welded around the round side seat tubes 14-1, 14-2, FIG. 1. The pivots 40 allow the seat back tubes 22 to fold forward over their corresponding seat side tubes 14-1, 14-2 for compact storage, FIG. 2B. Reinforcement of the pivot points 40 may be achieved in other ways without altering the scope of the invention, such as addition of side plates to the round side seat tubing or a sleeve of tubing over or inside of the round main side seat tubing 14-1, 14-2, or solid round stock material added inside the seat side tubing 14-1, 14-2 for additional support of the pivot pin, main side seat tubing may be of square construction rather than round, or support material below the pivot point may be added and extended flanges attached to the seat back tube that will brace against the surface of this added material.

In another embodiment, the folding chair includes an additional folding cross brace (not shown) at the upper rear of the seat back tubes 22 to resist the inward forces induced by the pressure of a person leaning back into the seat back 20. Such an additional folding cross brace may be similar to any descriptions for the braces 26 above.

Operation of the chair as shown from the folded condition in FIG. 2B to the open condition in FIG. 1 involves lifting the seat back 20 (either before or after the following steps) and pulling the main seat side tubes 14-1, 14-2 apart which starts to open the folding braces 26. Opening of braces 26 is completed by pulling forward on the front brace 26 while simultaneously pulling rearward on the rear brace 26 until their respective pivots 32 pass over center and arc held in place by fabric tension, or latching spring pins if provided.

A carrying bag may be provided for easily carrying the chair in the folded condition.

While the preferred embodiment of the invention has been illustrated and described, as noted above, many changes can be made without departing from the spirit and scope of the invention. For example, telescoping poles may used for the seat side tubes 14-1, 14-2 for the ability to compact the size of the folded chair even more. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A collapsible chair comprising:

two seat tubes configured to receive seat fabric, wherein the seat tubes form front and rear legs;

a first support tube being rotatably attached to the two front legs; and a second support tube being rotatably attached to the two rear legs, wherein the first and second support tubes include two sections connected by a hinge configured to allow the sections to become oriented in approximately a straight line when the chair is in a open position and to orient in an acute angle when the chair is in a close position, wherein the ends of the two sections of the tubes opposite the hinge comprise a sleeve that is received over the respective legs, wherein the two front legs comprise a pin mounted at a first height above a bottom of the legs, the two rear legs comprise a pin mounted at a second height above a bottom of the legs, wherein the sleeves include a horizontal groove configured to receive the pin of the respective leg.

2. The chair of claim 1, wherein the hinge is fixedly attached to a first one of the sections, the hinge comprises a pin for rotatably receiving a second one of the sections.

3. The chair of claim 2, wherein the pin of the hinge is located some distance away from a centerline of the first section, wherein the second section comprises an end having a hole for receiving the pin, the end having a centerline that is not parallel with a centerline of the second section, thus placing the pin receiving hole some distance away from the centerline of the second section.

4. The chair of claim 3, further comprising seat back post rotatably mounted to each of the seat tubes, wherein the seat back posts are configured to receive a seat back fabric.

5. The chair of claim 4, wherein when the chair is in the close position the first support tube is folded at a height above the second support tube at a position within the four legs and the seat back posts are folded to an approximately parallel position with the seat tubes.

* * * * *